US006895882B1

(12) United States Patent
Dahmen et al.

(10) Patent No.: US 6,895,882 B1
(45) Date of Patent: May 24, 2005

(54) LIGHT-WEIGHT CODE-ZERO HEADSAIL SYSTEM

(75) Inventors: Joseph Dahmen, Lincoln, MA (US); Clarke Bassett, Westbrook, CT (US)

(73) Assignee: Cruising Design, Inc., Homer, NY (US)

( * ) Notice: Subject to any disclaimer, the term of this patent is extended or adjusted under 35 U.S.C. 154(b) by 32 days.

(21) Appl. No.: 10/708,437

(22) Filed: Mar. 3, 2004

(51) Int. Cl.[7] ..... B63H 9/04
(52) U.S. Cl. ..... 114/106; 114/108
(58) Field of Search ..... 114/102.1, 105, 114/106, 108, 111, 112, 113

(56) References Cited

U.S. PATENT DOCUMENTS 3,611,969 A * 10/1971 Hood ..... 114/106
3,789,790 A * 2/1974 Crall ..... 114/106
3,958,523 A * 5/1976 Holmes et al. ..... 114/106
3,980,036 A * 9/1976 Crall ..... 114/106
4,080,917 A * 3/1978 Alter et al. ..... 114/106
4,248,281 A * 2/1981 Hood ..... 114/106
4,723,499 A * 2/1988 Furgang ..... 114/106
5,463,970 A * 11/1995 Hartlmeier et al. ..... 114/105
5,890,447 A * 4/1999 Bernson ..... 114/106

* cited by examiner

*Primary Examiner*—Lars A. Olson
(74) *Attorney, Agent, or Firm*—Mark P. White

(57) ABSTRACT

A headsail for a sailing boat includes a luff rope having a core of parallel filaments of high-tenacity polyester and a tightly braided polyester cover, affixed in proximity to the headsail's luff. An upper marine eye is affixed to an upper end of the luff rope, while a lower marine eye affixed to a lower end of the luff rope. A length of shrink-wrap tubing is disposed about a shank of each marine eye, and is firmly shrunk about both the shank of the corresponding marine eye, and about the luff rope in proximity to the shank. A drum affixed to the lower marine eye includes a bearing assembly having an upper race, and is disposed within the drum body which contains a lower race, the bearing assembly suspended between a plurality of lower balls disposed between the upper race and the lower race, and a single upper ball. Means for restricting an excursion of the upper race relative to the lower race prevents the lower balls from distortion beyond their breaking point.

14 Claims, 10 Drawing Sheets

LIGHT-WEIGHT CODE-ZERO HEADSAIL SYSTEM

BACKGROUND OF INVENTION

Furling systems for the jibs and other headsails of sailboats are well known and widely used. The most common of these furling systems involves three basic components: (1) a luff extrusion, which runs along the forestay of the boat, and which holds the luff of the sail; (2) a drum or wheel mounted on the bow of the sailboat, used to "wind up" the sail about the extrusion; and (3) a swivel bearing mount which can slide along the top of the extrusion, and which allows the halyard to hold the sail up while permitting the extrusion to rotate at its top end relative to the forestay.

This prior art embodiment may be seen in FIG. 2. The tabling of the luff 16 of the jib l4 is sewn around and seized to the luff rope 1. The drum 26 rotatably attaches the bottom of the extrusion to the bow 30 of the boat. At the top of the extrusion the swivel 24 allows the luff wire or rope to rotate with respect to the halyard 12, which is directed through the masthead 88, and then back toward the deck of the boat.

Recent innovations in sail design have included the so-called "Code Zero" asymmetric headsail. The code zero is a free-flying sail, useful at apparent wind angles of between 40 and 65 degrees APP (apparent wind angle). These sails fill a niche between the Genoa jib and spinnaker, and have become popular with cruising sailors as well as racers.

Code zero sails generally contain their own furling systems, known as Code Zero Furlers, since Code Zero sails may be repeatedly set and struck during a single sail or race. FIG. 1 shows a typical prior art Code Zero Furler. These furlers differ from the older prior-art furlers in that they do not use luff extrusions, but rather use a luff wire, sewn into the luff of the sail in place of the extrusion. Because the luff wire does not have the torsional stiffness of the extrusion, Code Zero luff systems are not generally used as reefing systems. That is to say, these furlers are used either with the sail flying, completely unwound from the luff rope, or completely furled, with no sail area exposed.

The prior art Code Zero Furler may be understood by first referring to FIG. 1. A luff wire 9 is sewn into the luff of jib 1. At the lower end, or "tack" of the jib the luff wire is terminated with a lower eye 3, which is then affixed to furler wheel 2. At the upper end, or "head" of the jib the luff wire terminates in an upper eye 5, which is affixed, in turn to upper swivel 5, which in turn attaches to fitting 7. In many systems, the swivel is permanently affixed to the head of the jib, and the furler wheel is permanently affixed to the tack of the jib. When multiple headsails of this type are used, each contains its own swivels and furler wheels or drums, and these are generally of much smaller size and lighter weight than other types of prior art swivels and furler wheels.

Although FIG. 1 shows only a single headsail for the purpose of illustrating the principle, in practice Code Zero sails are often flown while another headsail is present, either flying or furled.

The use of a luff wire is dictated by the generally high-tension loads placed on the luff of the Code Zero headsails. The object of this feature is to reduce the sag of the forestay. These loads result from the large sail areas of these sails, from the full cut of the sails, and from the fact that these sails are usually mast-headed sails, running up to the very top of the mast 6, adding to the size of the sail.

The use of wire in the luff causes a number of problems, however. First, the wire is heavy, and awkward to handle. It does not bend easily and so the sail cannot be easily folded into a standard sail bag for storage.

A final problem involves the use of this Zero Code furling system for reefing the sail. Reefing differs from furling in that the former provides a reduced sail area under high wind conditions, where it is desirable to keep Zero Code sail aloft, but with the sail area reduced.

However, the steel cable does not have sufficient torsional stiffness to allow for reefing under high wind conditions. The foot of the sail, being subjected to higher tension due to the larger sail area at the foot, will twist the luff cable more than the head of the sail, leading to unacceptable sail deformation. However the present invention provides for the use of a lightweight rope of a much greater diameter than the heavier steel cable, so that a much thicker, and therefore stiffer rope cable can be used, with the possibility of reefing as well as furling.

A second departure of the present system involves the use of a novel furling drum, which contains a stop to take the pressure off the ball bearings themselves when subjected to excessive forestay tension. Ball bearings of the type used in the prior art for furler drums and wheels are most failure prone in tension mode, and Code Zero furlers are subject to tension forces far in excess of the other prior art furlers, due to the large sail area of Code Zero sails, and also due to the tendency of racing skippers to try to get the headsail luffs as tight as possible, thereby enhancing the aerodynamic characteristics of these sails. The use of the stop in the ball bearing mechanism provides a safety margin, so that when the furler is over-stressed the bearings will not fail, but will simply stop turning. If the bearings lock up in this way, and the sail needs to turn, as when coming about, the halyard need only be slackened momentarily to permit the turn, and can then be tightened down again.

SUMMARY OF INVENTION

It is an object of the present invention to provide a headsail with a lightweight, but strong luff-rope assembly with high torsional rigidity that will withstand the high tensile forces inherent for use in Code-Zero furling systems. It is a further object of this invention to provide such a headsail in which the luff rope is sufficiently flexible that the sail may be rolled up for transporting in a sail bag or similar container. It is a final object of this invention to provide a furling drum and swivel attached to the luff-rope, which is strong, compact, lightweight, and which contains a means from preventing the ball bearing system from failing when the luff rope is under heavy tension but the bearing is not required to turn.

In accordance with one aspect of the current invention a headsail for a sailing boat contains a luff rope fabricated from a core of parallel filaments of high-tenacity polyester and a tightly braided polyester cover with low crossover angle.

In accordance with a second aspect of the current invention an upper marine eye is affixed to an upper end of the luff rope, and a lower marine eye is affixed to a lower end of the luff rope.

In accordance with a third aspect of the current invention a length of heat shrink or shrink wrap tubing lined with holt melt glue is disposed about a shank of each marine eye, and is firmly shrunk about both the shank of the corresponding marine eye, and about the luff rope in proximity to the shank.

In accordance with a fourth aspect of the current invention the shank of the marine eye has ridges to better grip the tubing. The ridges result from swagg or may be subsequently formed or machined.

In accordance with a fifth aspect of the current invention the headsail further contains a rotating drum affixed to the lower marine eye.

In accordance with a sixth aspect of the current invention each marine eye is fabricated from a rod of material comprising aluminum, has a flattened head area with a transverse hole formed in the head area, and further contains a shank, the shank having a coaxial hole formed within, so that an end of the luff rope may be inserted into the coaxial hole.

In accordance with a seventh aspect of the current invention the luff rope is attached at each end to a marine eye by swaging.

In accordance with a eighth aspect of the current invention the drum further includes a bearing assembly having an upper race, and disposed within the drum body which contains a lower race, the bearing assembly suspended between a plurality of lower balls disposed between the upper race and the lower race, and a single upper ball.

In accordance with an ninth aspect of the current invention the drum possesses means for restricting an axial excursion of the upper race relative to the lower race, so that the lower balls will be prevented from distortion beyond a point of taking on a permanent deformation or breaking.

In accordance with a tenth aspect of the current invention a stop surface is integrally formed on the bearing assembly, the stop surface substantially parallel to the upper race, and which engages the lower race when sufficient tensile stress is applied to the drum.

BRIEF DESCRIPTION OF DRAWINGS

These, and further features of the invention, may be better understood with reference to the accompanying specification and drawings depicting the preferred embodiment, in which.

DETAILED DESCRIPTION

First Embodiment

Figure 5:
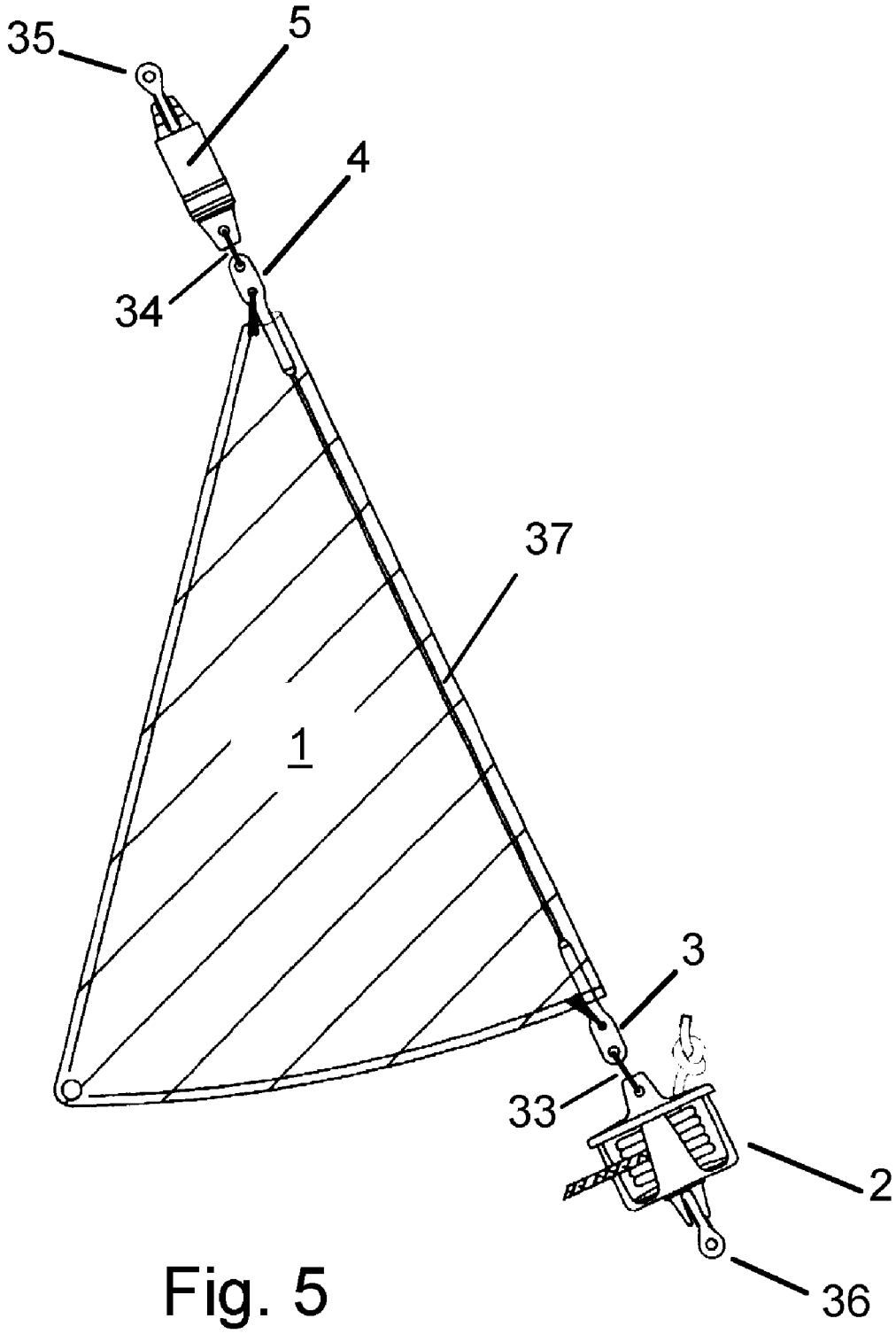
FIG. 5 depicts the luff rope of the current invention attached to a headsail, with furling drum in place.

The first embodiment may be seen by reference to FIG. 5. The luff rope 37 is sewn into the luff of the headsail 1, and is terminated at the upper end by an upper eye 4, and at the lower end by a lower eye 3. The lower eye is permanently attached to drum 2 by lower shackle 33, while the upper eye 4 is similarly permanently attached to the swivel 5 by upper shackle 34. When this sail/furling system is needed, the upper swivel eye 35 is attached to the jib halyard by a standard prior-art shackle or (not shown), or by a fast-disconnect device such as a snap hook. Similarly the lower drum eye 36 is connected to the bow plate or other fitting on the bow by the same means as the upper swivel eye.

Figure 9:
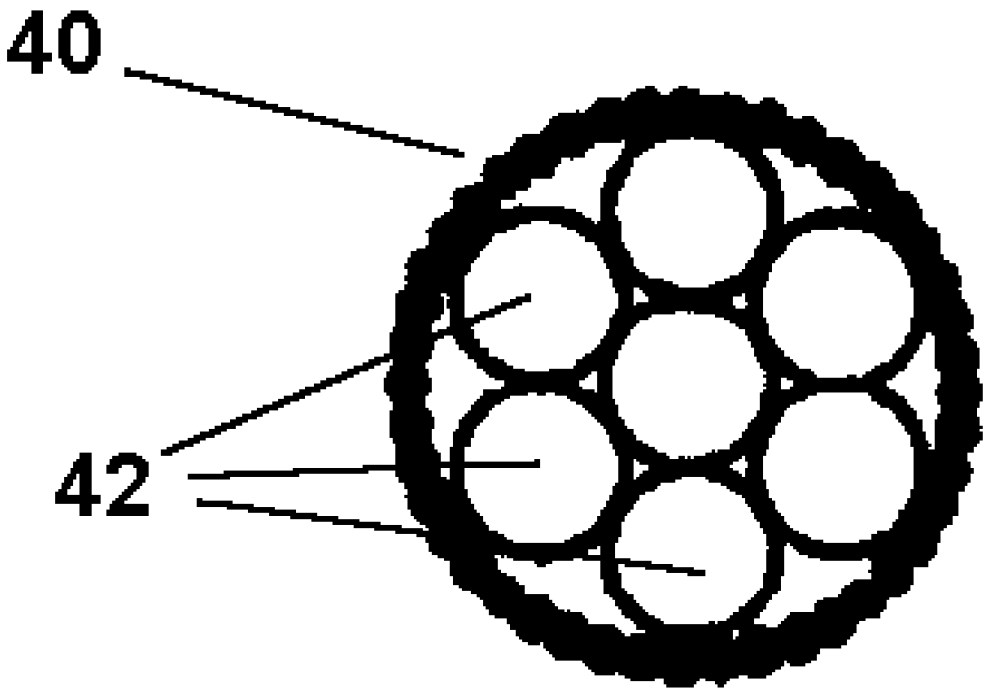
FIG. 9 depicts a cross section of the luff rope of the current invention.

The luff rope in this embodiment differs from the prior art in that it is a steel cable, while the current embodiment uses a rope having a core of parallel filaments of high-tenacity polyester and a tightly braided polyester cover. Such rope is commercially available from Samson Rope Technologies of Fernadale Washington, under the trade name "Duravet" and is sold for use primarily in concrete soil erosion mats. FIG. 9 shows a cross section of this rope. The individual filaments 42 are shown in this figure in a size exaggerated as compared to the outer cover 40, for the sake of clarity. In practice the density of filaments is orders of magnitude greater than what is shown in FIG. 9. The use of Duravet ropes for the purposes described herein does not appear anywhere in the prior art.

According to the manufacturer's specifications, a ½-inch diameter rope of this type has a breaking weight of 15,000 lbs., but weighs only 9.7 lbs/100 feet. Duravet ropes of this diameter and greater are suitable for use in the present invention.

The specifications for this product are shown in Appendix A.

The rope is attached to the marine eyes at either end by one of several methods. One of the preferred methods is to insert the luff rope into a cylindrical recess in the shaft of the marine eye, and then swage the shaft, reducing the diameter of the cylindrical recess so that the luff rope is firmly gripped within the recess, which is a standard prior-art technique for connecting marine eyes to steel cables.

Figures 6A, 6B, 6C:
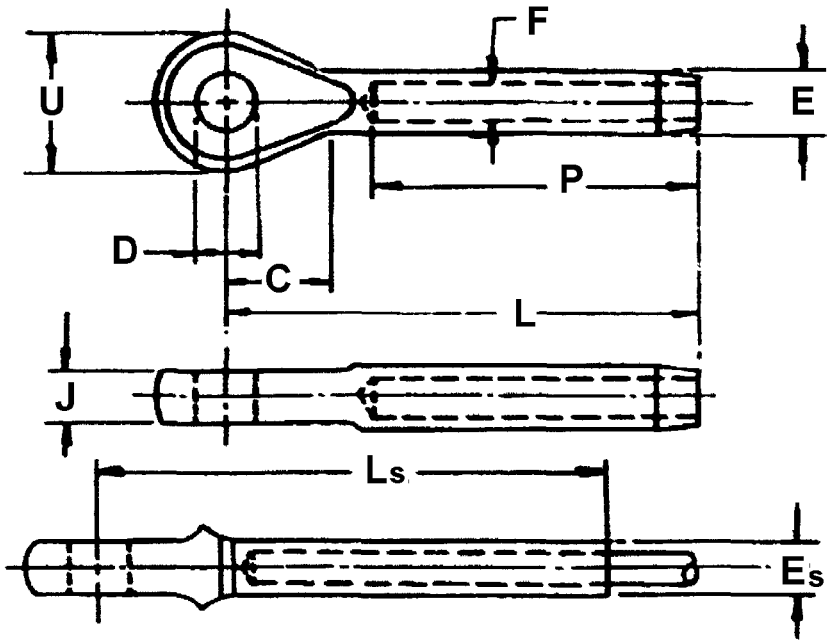
FIG. 6*a* depicts a front elevation view of a prior art marine eye.
FIG. 6*b* depicts a side elevation view of the prior art marine eye of FIG. 6*a*.
FIG. 6*c* depicts a side elevation view of the prior art marine eye of FIG. 6*a* after swaging.

The swaging process may be understood by referring now to FIGS. 6A, B, and C. FIG. 6A shows a right or left side elevation view of a marine eye, manufactured by Loos & Co. of Naples, Fla. The eye itself has an outer diameter of U, and an inner diameter of D. In the instant invention, part nos. EY1-10 through EY1-16, intended for cable sizes between 5/16 in. to ½ in. are used. The dimension U varies from 1.375 in. to 1.875. in. Dimension P, the channel in which the cable is inserted before swaging, varies from 3.250 in. to 4.750 in. The diameter of the cable channel is somewhat larger than the cable to be swaged. For a ½-in. cable, the cable channel, Dimension F, is 0.531 in. providing an additional 0.031 in. when the channel is inserted.

FIG. 6B shows a top or bottom plan view of this marine eye, which is symmetrical in these dimensions. The dimension of the eye portion itself is seen to be uniform across the eye. The outer dimension E of the shaft is 0.844 for the model intended for the ½-in. cable.

FIG. 6C shows the dimensions of the marine eye after swaging has been finished, so that the dimensions of the shaft have been compressed by the swaging process. The outer shaft dimension, Es, has now been reduced to about 0.750 in., with the cable reliably captured within the channel.

Steel cables are ideal for swaging, because they can be easily led into the cable channel due to the stiffness of the steel cable. In the present case the luff rope is more difficult to lead into the cable channel, since the rope, while having superior torsional stiffness, and high tensile strength, bends much more easily than steel cable. For that reason, in the instant case the cable channel must be at least _____ inches greater in diameter than the outer diameter of the rope.

Although corrosion-resistant stainless steel is used for standard marine eyes, in the instant invention a non-anodized 6061 or 6063 aluminum is used, which is much more malleable than stainless steel, and requires much less pressure.

In addition to swaging on an aluminum marine eye to each end of the luff rope, it has been found that the area where the luff rope enters the marine eye is subject to excessive wear, as it constitutes a "stress raiser" if the rope is allowed to flex or bend at this point, and may be subject to various modes of failure, including stretching, twisting, and rupture.

It has been found that a length of shrink tubing, which is shrunk by the application of heat with a heat gun, applied with one end of the shrink tubing completely enclosing the marine eye shaft, and the other extending up the rope for a distance of 10 to 100 rope diameters, effectively eliminates the stress-raising effect of the junction between the rope and the shaft of the marine eye.

Furling Drum

In the present invention the luff rope is attached to the upper portion of a drum which is, in turn, attached in proximity to the bow of the sailboat. This drum permits the luff rope to rotate with respect to the bow.

In prior art furlers similar to the present furler, the drum or wheel has been left attached to the luff rope when the sail is struck, so that a separate drum or wheel is required for each headsail. A lightweight, compact drum or wheel is thus desirable for each Code Zero headsail.

Prior art drums have suffered from the need for heavy-duty bearing assemblies to bear the increased tensile forces on the drum inherent in Code Zero systems. The problem may be illustrated by referring next to FIG. 8*a*, which depicts a prior art radial bearing. The outer ring ball race 40 and inner ring ball race 44 are separated by the separator 42 which contains the balls themselves. The application of a load 46 can be seen to create a stress between the outer ring ball race relative to the inner ring ball race, which is borne entirely by the junction between the balls 48 and the races, tending to pull the races apart under high loads, and leading to catastrophic failure. Accordingly, this type of radial bearing has been found to have a limited load bearing capacity in the direction of the thrust load 46, although it does provide a reasonable capacity to handle radial loads.

Figure 8:
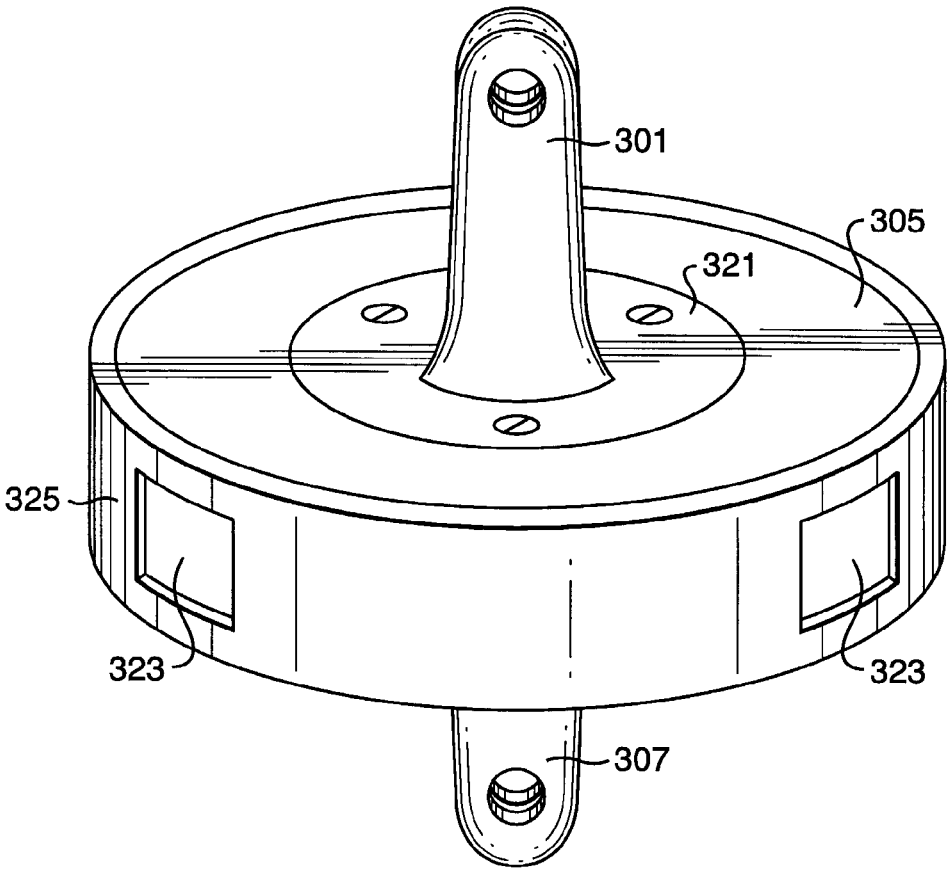
FIG. 8 depicts a perspective view of the lower luff drum of the current invention.
Figure 8A:
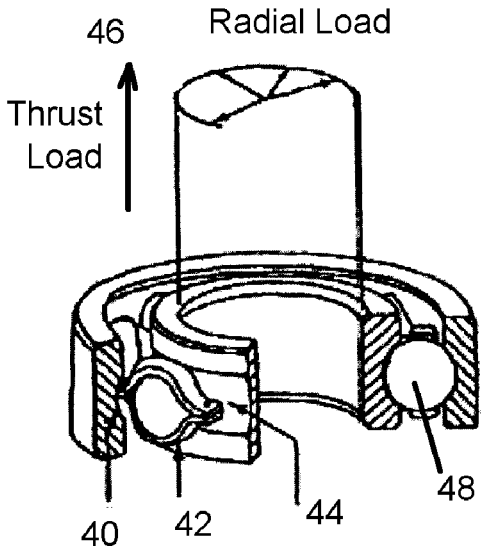
Fig. 8A (Prior Art)
FIG. 8*a* depicts a prior art radial bearing.
Figure 8B:
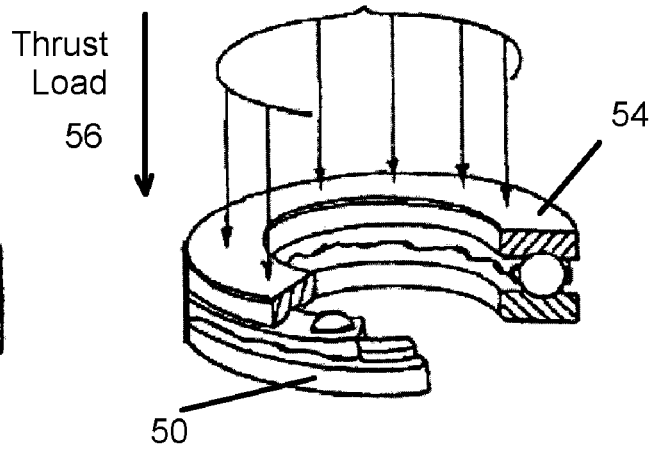
Fig. 8B (Prior Art)
FIG. 8*b* depicts a prior art thrust bearing.

The alternative thrust bearing, as shown in FIG. 8*b*, does not suffer the same kind of catastrophic failure as the radial bearing under thrust loads 56, but it does tend to compress the balls between the upper 54 and lower 50 races, thus causing the bearing to jam, or, in the case that the balls are made of a light-weight material such as plastic, to fracture.

The present invention provides a light-weight lower luff drum with a novel bearing system which has a bearing stop preventing the balls from being overstressed under conditions of extreme thrust loads, as may be expected when used in conjunction with Code Zero headsails.

Figure 1:
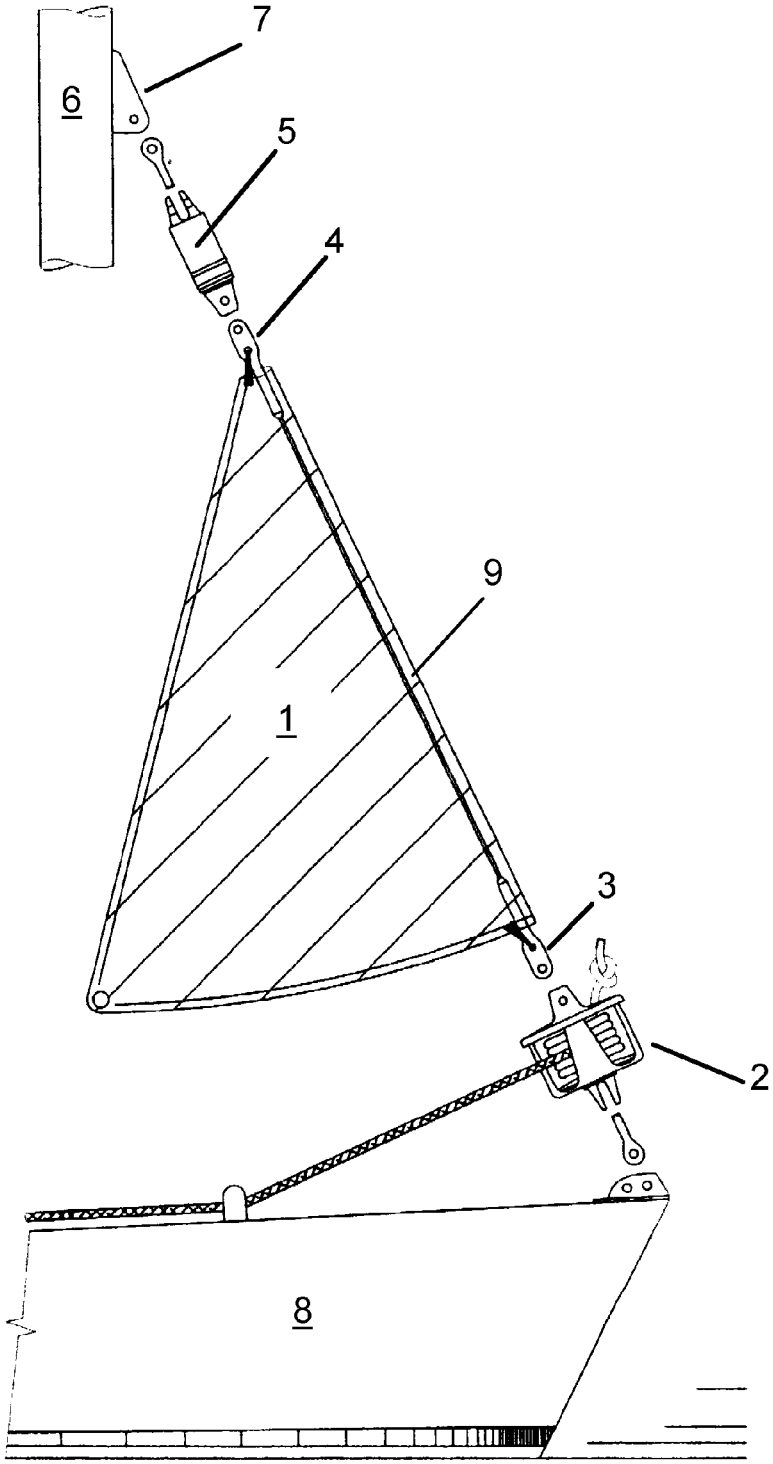
Fig. 1 (Prior Art)
FIG. 1 depicts a prior art headsail Code Zero furling system.
Figure 2:
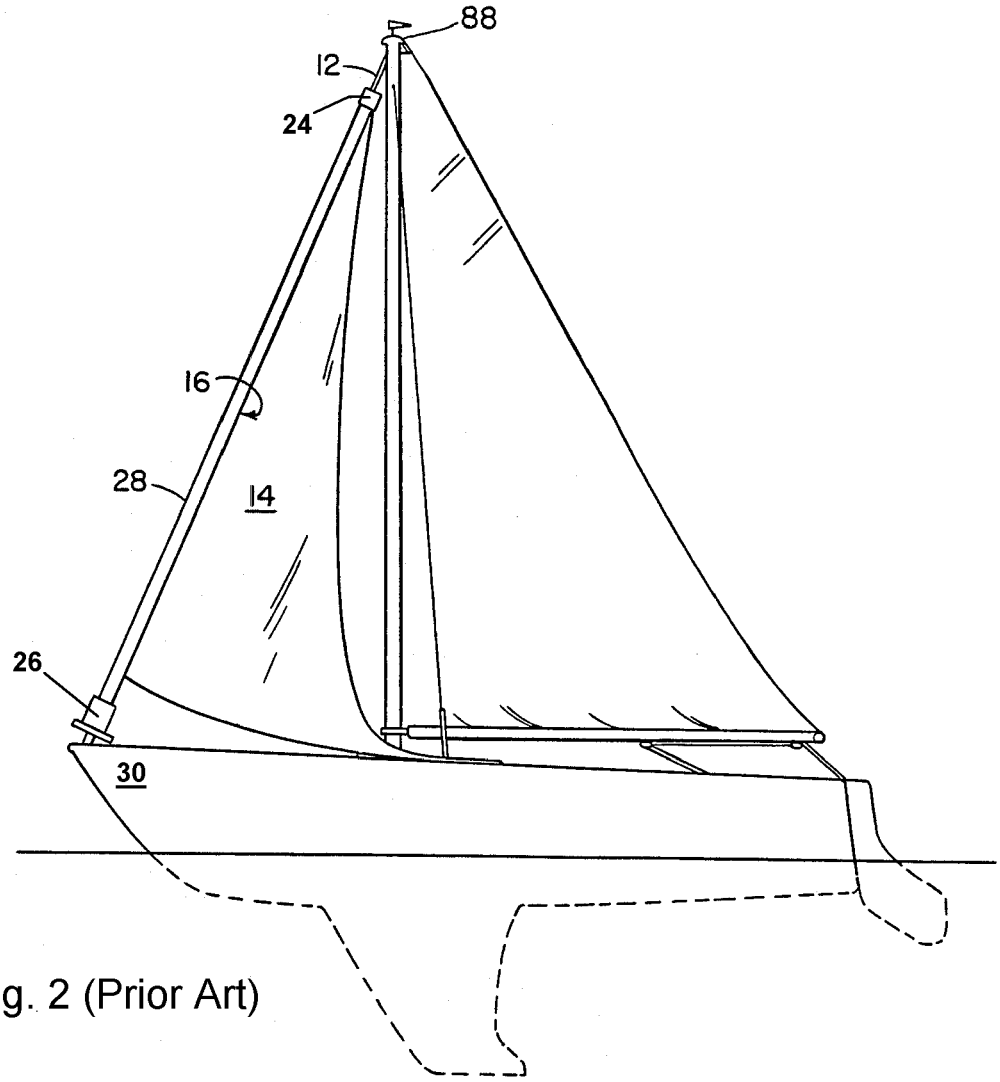
Fig. 2 (Prior Art)
FIG. 2 depicts a prior art headsail non-Code Zero furling system.
Figure 7A:
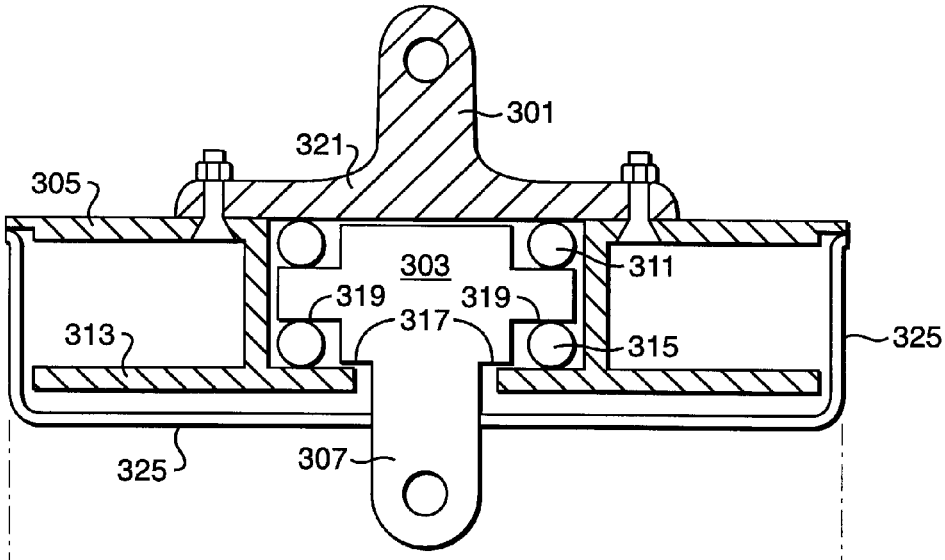
FIG. 7*a* depicts a cross-sectional representation of the lower luff drum of the current invention.

Referring now to FIG. 7*a*, the drum contains an upper fitting member 301, which attaches at its upper end to the bottom of the luff rope, and which attaches at its lower end to the drum body 305 by means of three bolts. The bearing assembly 303 is disposed within the drum body, and is suspended between the lower balls 315, and a the upper balls 311. The lower fitting 307 of the bearing assembly attach to a mating fitting on the bow 30 of the sailboat, as shown in FIG. 2.

It is clear from the depiction of FIG. 7*a* that a tensile stress on the luff rope will tend to pull the upper fitting member away from the lower legs of the bearing assembly, thus tending to compress the lower balls 315. The upper balls 311, are not subjected to any unusual stresses in the present application, because the drum assembly is not normally subjected to any compressive stress.

The tensile stresses on the drum will cause the lower balls 315 to compress, but this compression is limited by the geometry of the drum. The drum body contains a lower race surface 313, which lies directly below the bearing stop surface 317. The upper race surface 319 is contained by the bearing assembly. Under normal operating conditions, when the balls 315 are not compressed, the bearing stop surface will lie above the lower race surface 313, and the two surfaces will not be in contact. As the thrust stresses increase, however, the balls 315 will compress, and the bearing stop surface will approach the lower race surface, finally meeting before the compression of the lower balls becomes excessive.

When the lower balls are uncompressed and perfectly spherical, they contact the upper and lower race surfaces at a single point only, and the pressures at the contact points are very high. The contact area between the lower race surface 313, and the bearing stop surface is significantly higher, however, as the area of the surfaces in contact are orders of magnitude higher than that between the lower balls and the two race surfaces, and thus the distortion between the bearing stop surface and the lower race surface will be minimal, compared to that compression of the lower balls. As a result, the geometry of the drum assembly will prevent the lower balls from failing under compression under high tensile loads applied by the luff rope.

As a result, a small, lightweight drum may be fabricated out of various materials, including plastics, which will withstand the high-tension forces used in Code-Zero headsail systems. An outer shell 325 forms a protective casing for the drum, with lower assembly 307 protruding through the bottom of the shell.

Figure 7B:
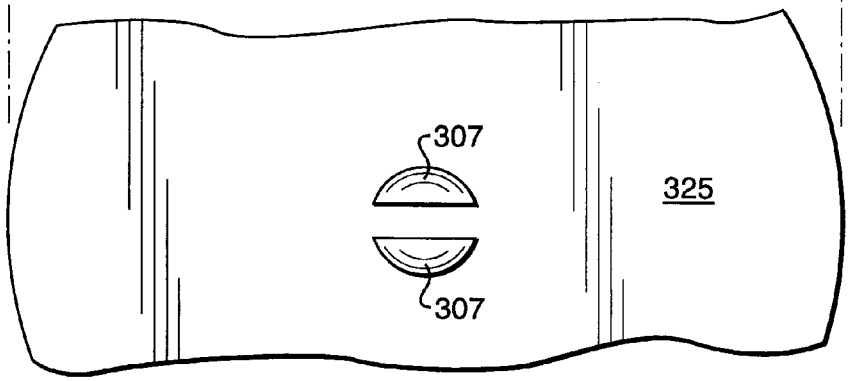
FIG. 7*b* depicts a bottom plan view of the lower luff drum of the current invention.

FIG. 7*b* depicts a bottom plan view of the drum, showing how the two flanges of the lower assembly 307 protrude through the bottom of the shell 325, so that the shell cannot rotate relative to the inner race 303 of the drum.

Referring now to FIG. 8, a perspective view of the drum shows two of the three windows 323 disposed a 120 degrees from each other around the circumference of the outer shell 325. The furling rope used to rotate the upper fitting assembly 301 and drum body 305 passes through one of the windows and is lead aft, generally to the cockpit of the sailboat.

Luff-Rope Eyes

The prior art Code-Zero luff wires are fabricated with marine eyes at either end, as shown in FIG. 5. These marine eyes 3, 4 are generally made of stainless steel, and are attached by swaging the luff wire to the marine eye. The marine eyes are then affixed to the upper swivel and lower drum by means of shackles 34, 36.

A typical marine eye is shown in FIG. 6*a*, in front elevation view. The eye has an enlarged head of dimension U, integrally formed on a shaft of diameter E, with an inner bore of diameter F, into which the luff rope will be inserted for a length P. FIG. 6*b* depicts a side elevation view of the marine eye, showing that the head has a somewhat reduced thickness J.

After the luff rope is inserted into the inner bore F of the shaft, the marine eye is swaged, resulting in a reduced diameter Es of the shaft, as well as a lengthening of the shaft to a length Ls, which is seen to have increased from the pre-swaging length L.

Although this process can be used on the luff rope of the present invention, the standard stainless steel marine eye is expensive to purchase. Furthermore, the swaging of stainless steel manufacture, such as the prior-art marine eye, requires expensive machinery to accomplish.

It has been found that an effective, low cost eye can be fabricated from a commonly used aluminum alloy, which requires much lower swaging pressures, as well as generally lower machining costs. Furthermore, aluminum is one-third the density of stainless steel, so weight aloft is reduced. The preferred alloys are 6061 and 6063 non-anodized aluminum, as defined by the ASTM B308/B308M-02 Standard, as promulgated by ASTM International, 100 Barr Harbor Drive, PO Box C700, West Conshohocken, Pa., a widely-accepted standards organization.

Figure 3:
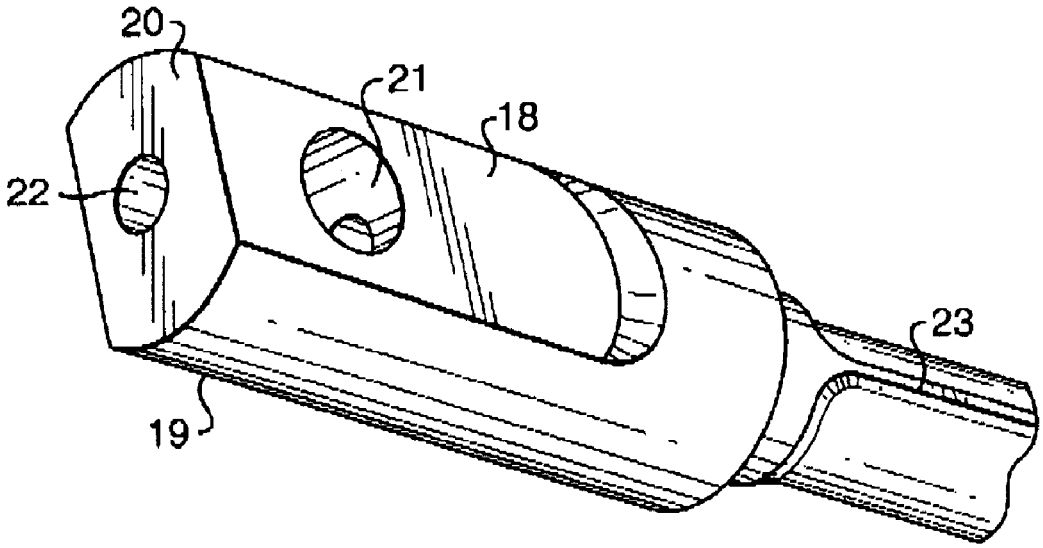
FIG. 3 depicts a simplified luff eye of the current invention.

The aluminum marine eye is shown in FIG. 3. The eye is fabricated from a bar of either 6061 or 6063 aluminum, with a diameter of approximately _____ inches. The bar has been machined to provide flat surfaces 18, 19, over a length of approximately _____ inches from the end 20 of the bar. Coaxial hole 22 has been drilled from the end 20 of the eye and extending coaxially through the shank 23 of the eye. Attachment hole 21 allows for the attachment of the aluminum marine eye to the upper swivel 5 on one end of the luff rope, and to the drum 2 on the other end of the luff rope.

Figure 4:
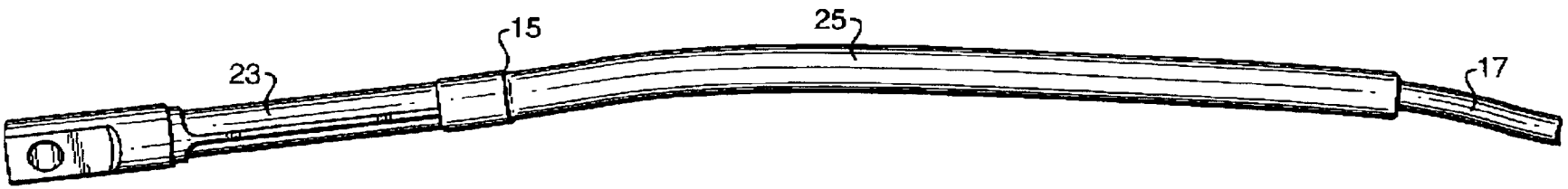
FIG. 4 depicts the simplified luff eye attached to the luff rope with outer shrink-wrap.

Referring now to FIG. 4, one end of the complete luff rope assembly is depicted. The luff rope 17, extends into the shank 23 of the aluminum marine eye, and area in proximity to the end of the shank 15 is enveloped by a piece of shrink-wrap tubing which extends onto the shank surface over a distance of an inch or more, and a distance of several inches over the luff rope to the right of the end 15 of the shank of the marine eye.

The use of this shrink-wrap is vital to the integrity of the luff rope, since it drastically lessens the stress-raising effect at the junction 15 of the luff rope and the shank end. Under normal circumstances, a failure of the luff rope will be at the point of such a junction, as the stresses caused by both axial and transverse rotations of the rope relative to the marine eye will concentrate at the junction. It has been found that these stresses can be minimized by the use of shrink-wrap tubing, as the shrink-wrap resists such axial and transverse rotations. Such shrink-wrap tubing is well known in the field of electrical and electronic fabrication. A typical shrink-wrap tubing is made from a thermoplastic, such as polyolefin, and has a wall thickness of between 0.5 mm and 3 mm. For the current application, a wall of thickness of between 2 and 3 mm is recommended.

The shrink-wrap tubing is applied by first sliding the tubing over the luff rope, then swaging the end of the rope onto a marine eye, and then sliding the shrink-wrap tubing over the shank of the marine eye, so that it covers the junction between the shank and the luff rope with an overlap of at least an inch on the shank side, and several inches on the luff rope side. Heat is then applied to the shrink-wrap tubing, so that it shrinks sufficiently so that it remains snugly attached at both sides of the junction.

While the invention has been described with reference to specific embodiments, it will be apparent that improvements and modifications may be made within the purview of the invention without departing from the scope of the invention defined in the appended claims.

What is claimed is:

1. A headsail for a sailing boat, the headsail comprising:

(a) a luff rope further comprising a core of parallel filaments of high-tenacity polyester and a tightly braided polyester cover, and affixed in proximity to a luff of the headsail;

(b) an upper marine eye affixed to an upper end of the luff rope, and a lower marine eye affixed to a lower end of the luff rope; and (c) a length of shrink-wrap tubing disposed about a shank of each marine eye, and firmly shrunk about both the shank of the corresponding marine eye, and about the luff rope in proximity to the shank.

2. The headsail of claim 1, further comprising a rotating drum affixed to the lower marine eye.

3. The headsail of claim 2, wherein each marine eye is fabricated from a rod of material comprising aluminum, and comprising a flattened head area with a transverse hole formed therewithin, and a shank, the shank having a coaxial hole formed therewithin, and wherein an end of the luff rope is inserted into the coaxial hole.

4. The headsail of claim 3, wherein the luff rope is attached at each end to a marine eye by swaging.

5. The headsail of any of claims 1 through 4, wherein the drum further comprises (a) an upper fitting member affixed at its upper end to the bottom of the luff rope, and affixed at its lower end to a drum body;

(b) a bearing assembly comprising an upper race, and disposed within the drum body which comprises a lower race, the bearing assembly suspended between a plurality of lower balls disposed between the upper race and the lower race, and a single upper ball; and (d) means for restricting an excursion of the upper race relative to the lower race, so that the lower balls will be prevented from distortion beyond a breaking point.

6. The headsail of claim 5, wherein the means for restricting the excursion of the upper race relative to the lower race further comprises a stop surface integrally formed on the bearing assembly, said stop surface substantially parallel to the upper race, and which engages the lower race when sufficient tensile stress is applied to the drum.

7. A method for fabricating a headsail for a sailing boat, the method comprising:

(a) affixing a luff rope in proximity to a luff of the headsail, the luff rope further comprising a core of parallel filaments of high-tenacity polyester and a tightly braided polyester cover;

(b) affixing an upper marine eye to an upper end of the luff rope;

(c) affixing a lower marine eye to a lower end of the luff rope; and (c) shrinking a length of shrink-wrap tubing about both the shank of the corresponding marine eye, and about the luff rope in proximity to the shank.

8. The method of claim 7, further comprising affixing a rotating drum to the lower marine eye.

9. The method of claim 8, wherein each marine eye is fabricated from a rod of material comprising aluminum, and comprising a flattened head area with a transverse hole formed therewithin, and a shank, the shank having a coaxial hole formed therewithin, and wherein an end of the luff rope is inserted into the coaxial hole.

10. The method of claim 9, further comprising affixing the luff rope at each end to a marine eye by swaging.

11. The method of any of claims 7 through 10, wherein the drum further comprises (a) an upper fitting member affixed at its upper end to the bottom of the luff rope, and affixed at its lower end to a drum body;

(b) a bearing assembly comprising an upper race, and disposed within the drum body which comprises a lower race, the bearing assembly suspended between a plurality of lower balls disposed between the upper race and the lower race, and a single upper ball; and (d) means for restricting an excursion of the upper race relative to the lower race, so that the lower balls will be prevented from distortion beyond a breaking point.

12. The method of claim 11, wherein the means for restricting the excursion of the upper race relative to the lower race further comprises a stop surface integrally formed on the bearing assembly, said stop surface substantially parallel to the upper race, and which engages the lower race when sufficient tensile stress is applied to the drum.

13. A drum for use in furling a headsail of a sailboat, the drum comprising:

(a) an upper fitting member affixed at its upper end to the bottom of a luff rope, and affixed at its lower end to a drum body;

(b) a bearing assembly comprising an upper race, and disposed within the drum body which comprises a lower race, the bearing assembly suspended between a plurality of lower balls disposed between the upper race and the lower race, and a single upper ball; and (d) means for restricting an excursion of the upper race relative to the lower race, so that the lower balls will be prevented from distortion beyond a breaking point.

14. The drum of claim 13, wherein the means for restricting the excursion of the upper race relative to the lower race further comprises a stop surface integrally formed on the bearing assembly, said stop surface substantially parallel to the upper race, and which engages the lower race when sufficient tensile stress is applied to the drum.

* * * * *